US008882017B2

(12) United States Patent
Woods

(10) Patent No.: US 8,882,017 B2
(45) Date of Patent: Nov. 11, 2014

(54) DOUBLE FLANGE CORRUGATED REEL

(75) Inventor: Justin Woods, Canton, OH (US)

(73) Assignee: Vail Industries, Inc., Navarre, OH (US)

( * ) Notice: Subject to any disclaimer, the term of this patent is extended or adjusted under 35 U.S.C. 154(b) by 182 days.

(21) Appl. No.: 13/359,187

(22) Filed: Jan. 26, 2012

(65) Prior Publication Data

US 2012/0234960 A1 Sep. 20, 2012

Related U.S. Application Data

(60) Provisional application No. 61/436,319, filed on Jan. 26, 2011.

(51) Int. Cl.
*B65H 75/22* (2006.01)

(52) U.S. Cl.
USPC ..... 242/407.1; 242/127; 242/401; 242/607.1

(58) Field of Classification Search
USPC ..... 242/127, 401, 407.1, 607.1
See application file for complete search history.

(56) References Cited

U.S. PATENT DOCUMENTS

| | | | | |
|---|---|---|---|---|
| 2,380,641 | A | 7/1945 | Freiler | |
| 3,222,011 | A | 12/1965 | Webb | |
| 3,284,022 | A | 11/1966 | Eifrid | |
| 3,412,847 | A | 11/1968 | Wise et al. | |
| 3,661,341 | A | 5/1972 | Eidrid | |
| 3,817,475 | A | 6/1974 | Goldstein | |
| 3,853,286 | A | 12/1974 | Beder et al. | |
| 3,876,073 | A * | 4/1975 | Herbetko | 242/608.7 |
| 5,203,516 | A | 4/1993 | Donaldson | |
| 5,735,483 | A | 4/1998 | Bierlein | |
| 8,480,024 | B2 * | 7/2013 | Ries | 242/608.7 |
| 2010/0264246 | A1 * | 10/2010 | Ries | 242/401 |

FOREIGN PATENT DOCUMENTS

| | | | |
|---|---|---|---|
| DE | 92 06 316 | U1 | 7/1992 |
| DE | 297 13 670 | U1 | 11/1997 |
| DE | 20 2007 004 582 | U1 | 8/2007 |
| FR | 1 444 596 | A | 7/1966 |
| GB | 589990 | A | 7/1947 |

OTHER PUBLICATIONS

EP 08835226.5 Supplementary Search Report (Jun. 5, 2011).

* cited by examiner

*Primary Examiner* — Sang Kim
(74) *Attorney, Agent, or Firm* — Fay Sharpe LLP

(57) ABSTRACT

A collapsible reel for storing wound items is preferably transported in a first or collapsed state and subsequently assembled or deployed into an operative, second state. First and second sidewalls having a first thickness are pulled apart to a second operative position. Arm portions form a central core around which the media is wrapped, and sidewall portions are disposed at one end of select arm portions to provide additional sidewall thickness to the final assembly.

20 Claims, 13 Drawing Sheets

DOUBLE FLANGE CORRUGATED REEL

This application claims the priority benefit of U.S. provisional application Ser. No. 61/436,319, filed Jan. 26, 2011. This application is commonly owned by and cross-reference is made to related published International Application WO 2009/046297 (International Application No. PCT/US2008/078749, filed Oct. 3, 2008), the disclosure of which is incorporated herein by reference.

BACKGROUND OF THE DISCLOSURE

The present disclosure is related to a collapsible structure or reel for supporting and/or storing of flexible media such as wire, cable, and the like, although the reel may be used in association with other similar applications. Reels of this type are used to support wound flexible media such as rope, wire, electrical cable, tubing, chain, strings of parts, and the like. A core of the reel serves as a central support surface around which the flexible media is wound, and sidewalls or flanges are disposed at opposite ends of the core. Conventional reels are formed of wood or a composite of wood and metal.

Although these wood/metal reel structures are able to adequately store and dispense flexible media, such reels are generally expensive to manufacture and cannot be shipped to the end customer in a reduced dimension. Likewise, once the reel is empty the reel is typically disposed of or must be returned for re-use. Shipping and transportation costs become an issue because the cable reel takes up a considerable amount of space. Thus, the reel described in the commonly owned international application noted above provides a commercially viable alternative by way of a collapsible reel made from a single media such as a corrugated material, particularly a plastic or paperboard corrugated material.

The collapsible reel is simple in design, inexpensive to manufacture, and easily converted by the end user from a collapsed state or position to a deployed or use state/position. This has led to a need to add further strength to the reel structure while still maintaining the ability to transport the assembly in a first, collapsed condition and easily assemble the reel to the second, deployed position. Merely increasing the thickness of each wall portion that forms the core and sidewalls or flanges is not a viable alternative.

It is also desirable to provide for increased strength and rigidity of the reel structure while minimizing the amount of adhesive or glue, and precisely locating the application of adhesive to enhance the strength and ability to easily open/close between collapsed and deployed positions.

Accordingly, a need exists for a lightweight collapsible reel that has a high strength-to-weight ratio with low manufacturing costs, and that adds additional strength and rigidity to prior arrangements while maintaining ease of assembling the reel and can be effectively recycled.

BRIEF DESCRIPTION OF THE DISCLOSURE

A collapsible reel for storing wound items includes first and second sidewalls, each having a first thickness. First arm portions have a length that extends from a first end to a second end, and the first arm portions cooperate to form discrete circumferential portions of a core. Selected ones of the first arm portions include sidewall portions at the second ends thereof that cooperate to engage an inner surface of at least one of the sidewalls and provide additional strength thereto.

The selected ones of the arm portions including sidewall portions are substantially longer in dimension than the first arm portions.

The sidewall portions are dimensioned to preferably extend over an entire inner surface of a sidewall from the core to an outer perimeter of the sidewall.

Sidewall portions cover approximately one-fourth (¼) of the inner surface area of one of the sidewalls.

The sidewall portions are preferably hinged at the second ends of the selected first arm portions. The sidewall portions include locking members for mechanically engaging the respective sidewalls, for example, the first arm portions preferably include tabs extending outwardly therefrom, selectively received in openings in the sidewalls.

The first and second sidewalls are spaced apart by a first dimension in a collapsed state and spaced-apart a greater, second dimension in the operative state.

The entire reel is formed from the same material, preferably a corrugate material in a preferred arrangement.

An alternative embodiment of a collapsible reel includes first and second sidewalls that are each formed from first and second portions. That is, each sidewall portion has a first, inner portion that is adhesively secured to a second, outer portion. Along the first portion and generally centrally located adjacent the rotational axis are provided pie-shaped arm segments that are hinged along their outer periphery to the inner first portion, and include a second hinge region approximately half way along the radial extent, and that are adhesively secured to respective cooperating pie-shaped arm portion extending from the inner portion of the other sidewall.

Locking arms extend from the outer portion of each of the sidewalls at circumferentially spaced locations and are hinged so that the locking tabs or arms may extend toward the inner portion of the other sidewall for receipt in a recess in the first portion. Thus, when the first and second sidewalls are separated from one another and the reel adopts a deployed position, the locking arms are located radially outward of the first arm portions and lock the sidewalls in a deployed arrangement, and add further rigidity to the deployed structure.

Openings are provided through the first and second portions of each sidewall to facilitate deployment from the collapsed to the deployed position. Preferably, the first and second portions are adhesively secured together around these openings, and also via a continuous region of adhesive adjacent the perimeter of the first and second portions.

A method of assembling the collapsed reel includes deploying the first and second sidewalls from a first dimension to a spaced-apart greater, second dimension in an operative state. First arm portions are deployed to form discrete circumferential portions of a core. Sidewall portions of the arms are deployed adjacent the first and second sidewalls in the operative state.

The sidewall portions are locked to the first and second sidewalls through a mechanical engagement.

A primary benefit of the present disclosure is the ability to substantially increase the strength of a collapsible reel.

Another advantage is associated with forming the reel components from a single material.

Yet another benefit is associated with using a material that can be easily recycled.

Still another advantage resides in the ease and reduced expense associated with manufacture of the reel.

Still other advantages and benefits of this disclosure will become apparent upon reading and understanding the following detailed description.

DETAILED DESCRIPTION OF THE PREFERRED EMBODIMENT

Figure 1:
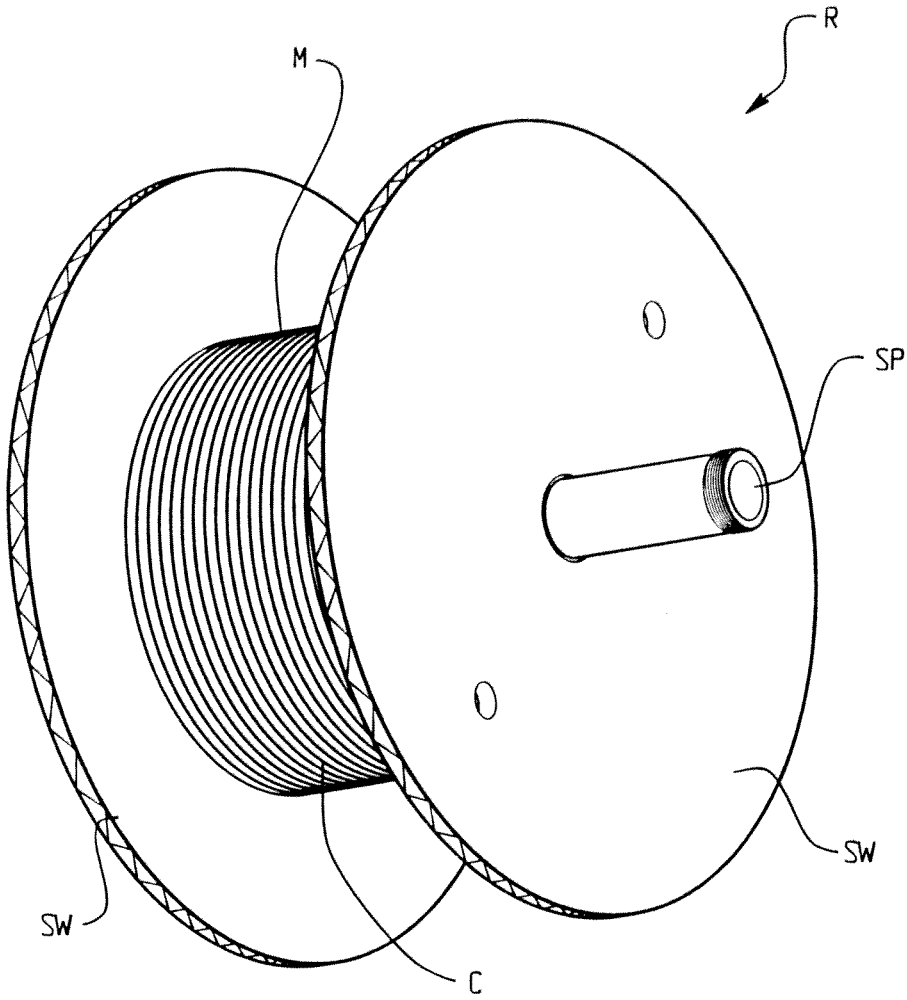
FIG. 1 is a perspective view of the cross-referenced co-pending application.

FIG. 1 shows a reel or reel assembly R having a core C over which a media such as flexible media M is wound and contained between sidewalls or flanges SW. A support shaft or spindle SP extends longitudinally through the core and extends outwardly in a generally orthogonal direction from the first and second sidewalls SW to rotatably support the reel. In the particular illustrated arrangement of FIG. 1, each of the sidewalls is formed of a corrugate material having a single thickness.

Figure 2:
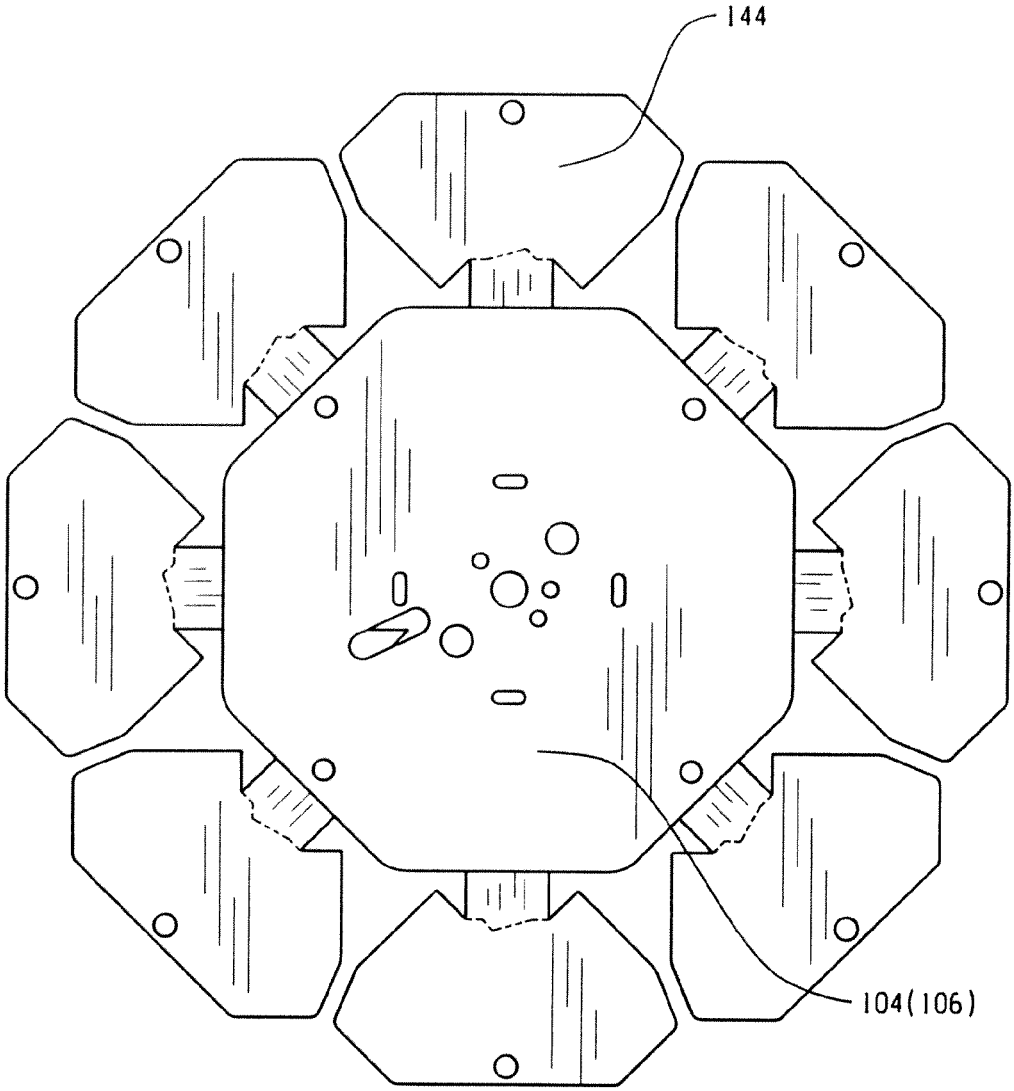
FIG. 2 is a plan view of the reel in a collapsed condition.
Figure 3:
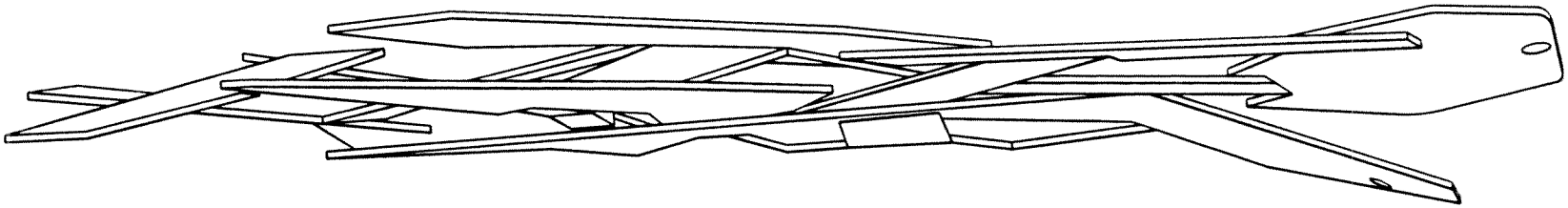
FIG. 3 is an end view of the reel in a collapsed condition.
Figure 4:
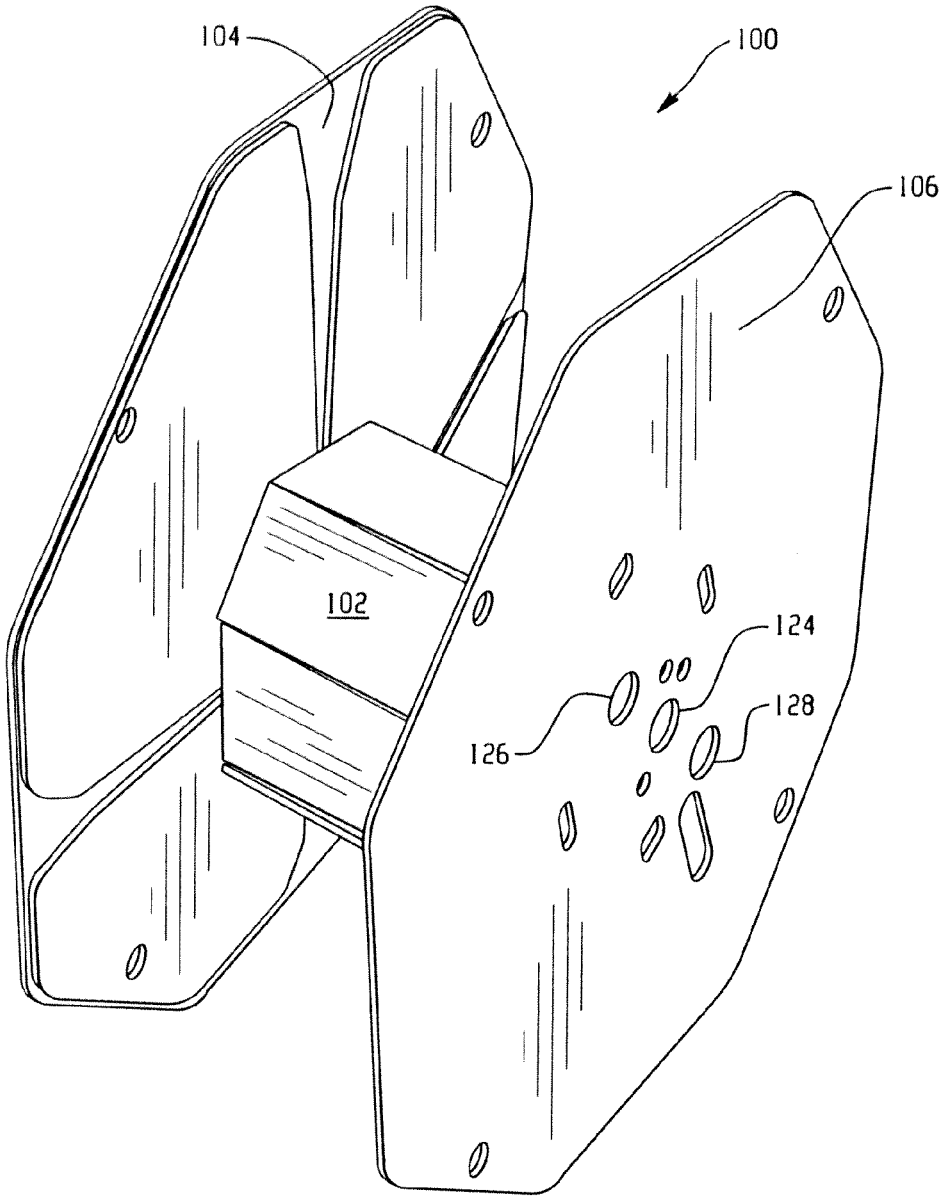
FIG. 4 is a perspective view of the reel in a deployed or operative state.
Figure 5:
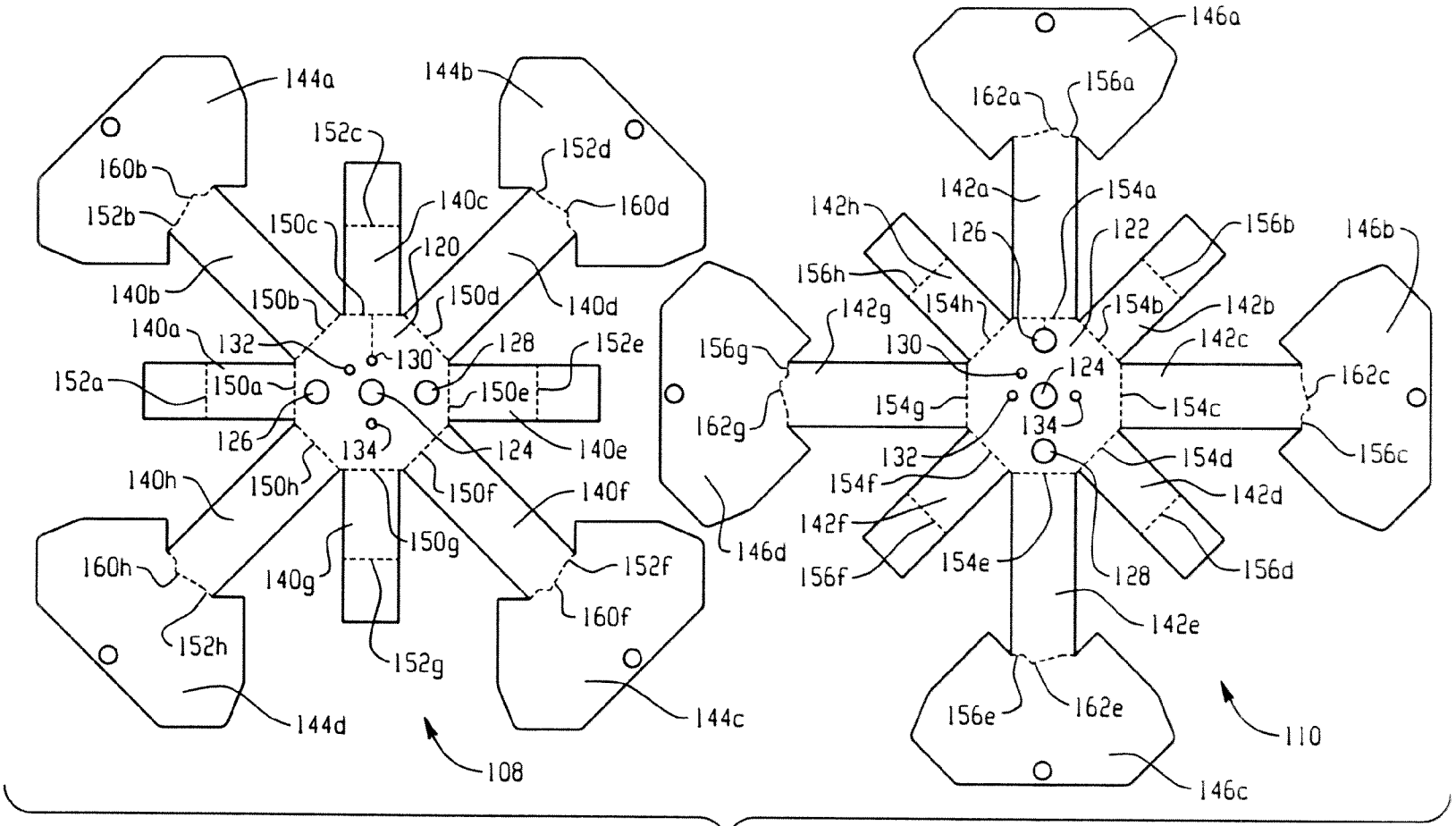
FIG. 5 is a plan view of the arm portions in disassembled relation.
Figure 6:
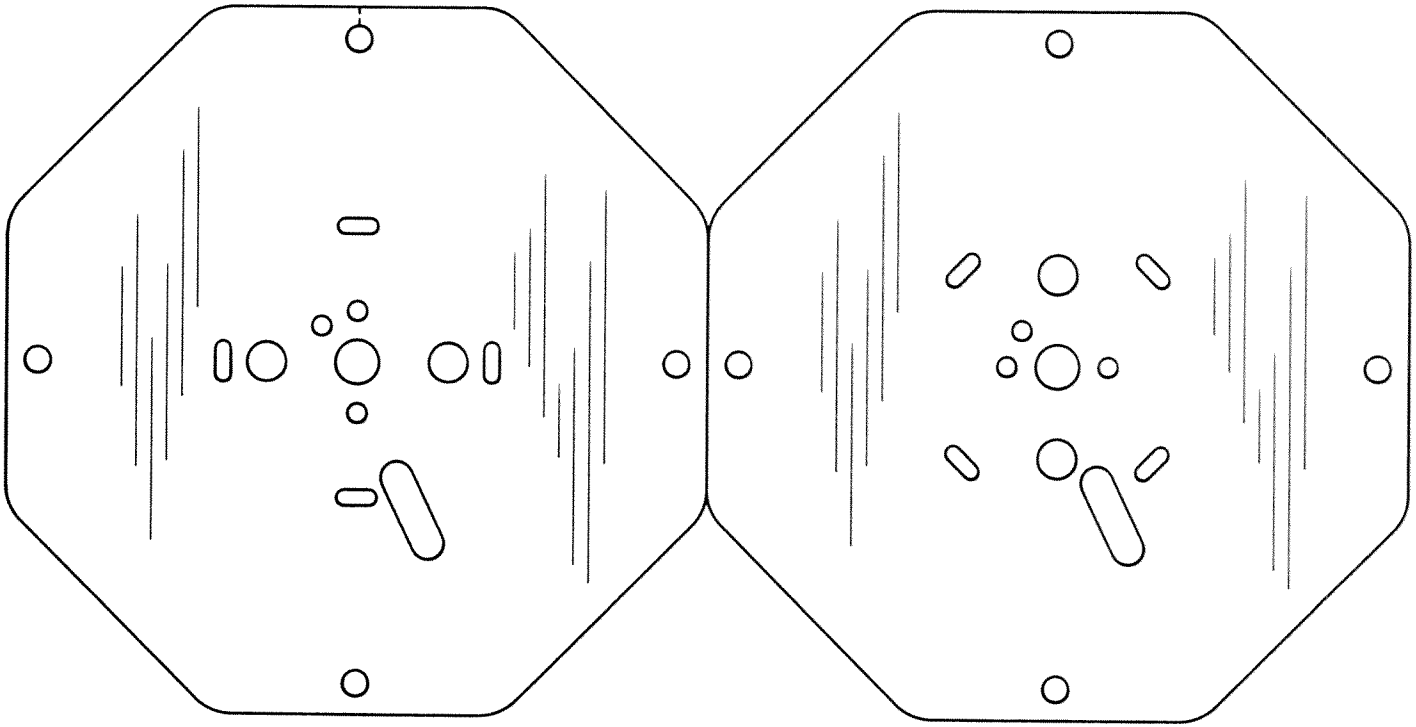
FIG. 6 is a plan view of the first and second sidewalls in disassembled relation.

Turning now to FIGS. 2-4, the collapsible reel of the present disclosure will be described in greater detail. The reel 100 includes a core 102 and first and second sidewalls 104, 106. The core is preferably formed from identical or substantially identical first and second sidewall-forming members 108, 110 (FIG. 5). Central portions 120, 122 of the sidewall-forming members 108, 110, respectively, are secured to respective first and second sidewalls 104, 106 (FIG. 6). Only the central portion is fixedly (e.g., adhesively) secured to the inner surface of a respective sidewall. In the preferred arrangement, the central portions are generally octagonal-shaped and substantially reduced in dimension relative to the octagonal-shaped perimeter of the first and second sidewalls 104, 106, although it will be appreciated that other conformations may be adopted without departing from the scope and intent of the present disclosure.

A central opening 124 is provided in each portion 120, 122, and dimensioned to receive a spindle of the type shown in FIG. 1. In addition, supplemental openings 126, 128 are dimensioned to receive a drive member (not shown) to rotate the reel about the longitudinal axis of the spindle, and/or are used for alignment purposes of the sidewall-forming members 108, 110 with the sidewalls 104, 106. Similarly, supplemental openings 130, 132, 134 may be provided for alternative drive arrangements and/or alignment purposes. It will be appreciated that securing the central portions of the first and second sidewall forming members 108, 110 is done in a manner so that these openings are aligned with one another through the core.

Extending generally radially outward as seen in FIG. 5 are first arm portions 140. Since there are eight first arm portions in the preferred arrangement, they are noted as 140*a*-140*h* on the first sidewall forming member 108. Similarly, second arm portions 142 extend radially outward from the central portion 122 of the second sidewall forming member. At least every other one of the first and second arm portions, namely, 140*a*, 140*c*, 140*e*, 140*g*, and 142*b*, 142*d*, 142*f*, and 142*h* have an uninterrupted radial length that defines the length of the core. Stated another way, the length of the core is the dimension between the sidewalls in the second or deployed, operative position. At the end of each of these selected first and second arm portions is also provided a sidewall portion 144, 146, respectively. The first sidewall forming member 108 includes four (4) sidewall portions 144*a*-144*d*, that are disposed on the radial outer ends of respective first arm members 140*b*, 140*d*, 140*f*, and 140*h*. These selected first arm portions that include the sidewall portions are hinged along fold lines 150 (150*a*-150*h*) with the central portion 120 and hinged at their outer or second ends along fold lines 152 (152*b*, 152*d*, 152*f*, 152*h*) at the interface with the sidewall portions. Similar fold lines 154 (154*a*-154*h*), 156 (156*a*, 156*c*, 156*e*, 156*g*) are provided at the interface of the second arm portions 142 with the central portion 122 and sidewall portions 146 (146*a*-146*d*), respectively.

In addition, fold lines 152 and 156 preferably include a tab cutout 160 (160*b*, 160*d*, 160*f*, 160*h*), 162 (162*a*, 162*c*, 162*e*, 162*g*) so that as the sidewall portions 144*a*-144*d* and 146*a*-146*d* are folded relative to their respective arm portions 140*b*, 140*d*, 140*f*, 140*h* and 142*a*, 142*c*, 142*e*, 142*g*, the tab cutout extends generally perpendicular to the sidewall portions 144, 146. That is, as originally formed in a planar sheet, each of the arm portions and sidewall portions are disposed in the same plane. However, the central portion is then secured to a respective sidewall, and each of the arm portions folded along a respective fold line 150 so that the arm portions form a portion of the circumference of the core between the sidewalls. The sidewall portions 144, 146 then form or create an added thickness or second thickness to each of the sidewalls so that the sidewall assembly formed by first sidewall 104/146 and second sidewall 106/144 has a double thickness for added rigidity.

Figure 7:
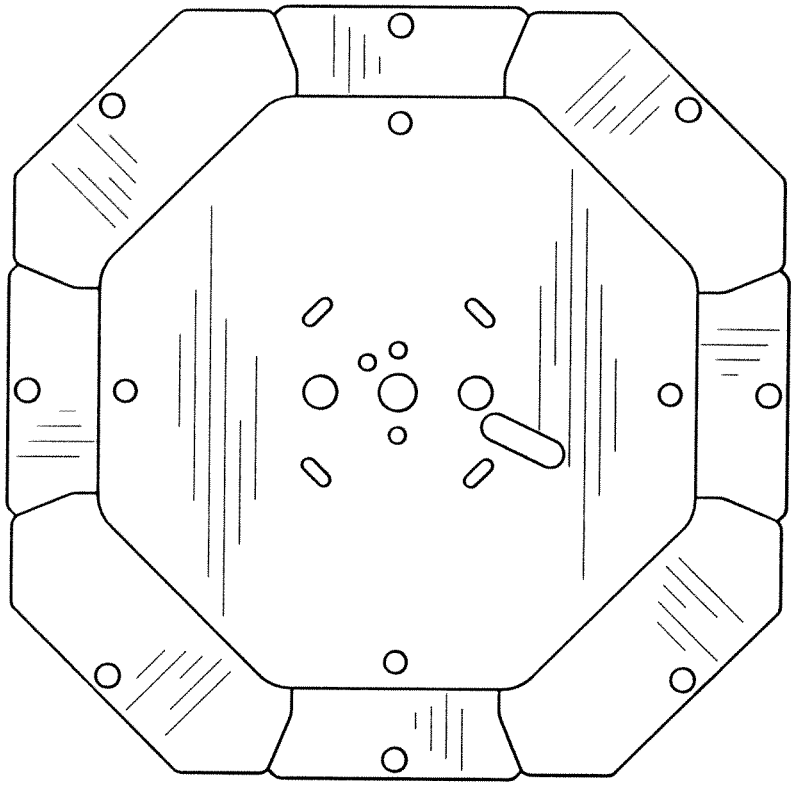
FIG. 7 is a plan view of the reel in an interim state between FIG. 2 and FIG. 4.
Figure 8:
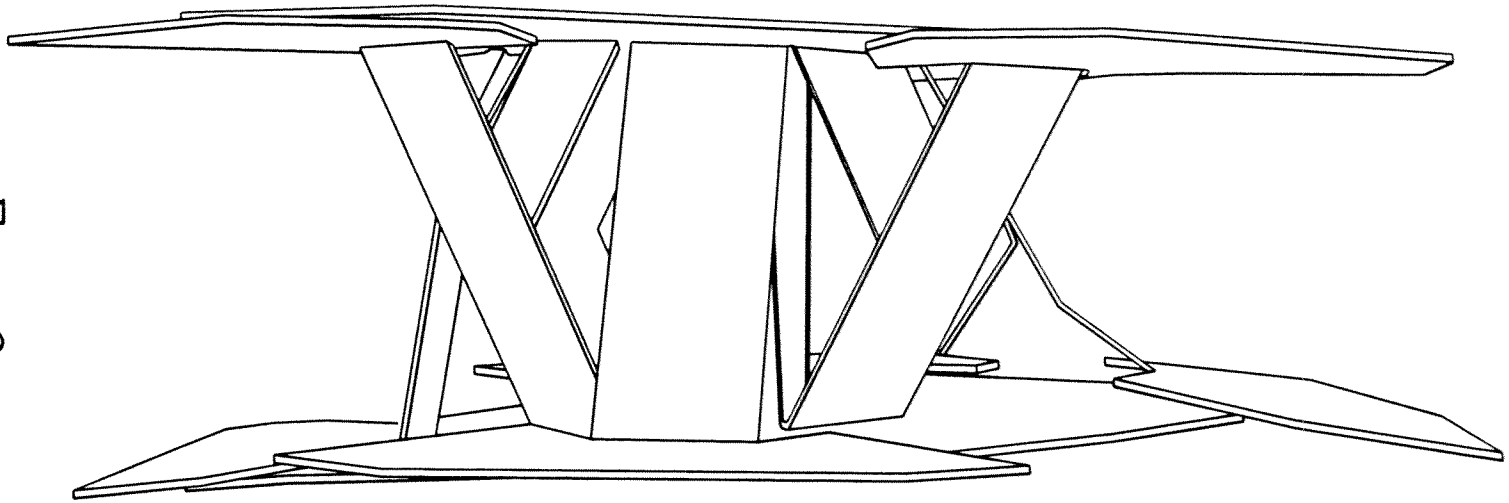
FIG. 8 is an end view of the interim state of FIG. 7.

The selected arm portions (i.e., that have a sidewall portion at one end thereof) (140*b*, 140*d*, 140*f*, 140*h* and 142*a*, 142*c*, 142*e*, 142*g*) serve the dual purpose of forming a portion of the circumference of the core, as well as forming the second thickness portion of the sidewalls. The non-selected arm portions are folded along fold lines 150 (150*a*-150*h*) and 154 (154*a*-154*h*) with the central portions, respectively. In addition, fold lines 152 (152*a*, 152*c*, 152*e*, 152*g*), 156 (156*b*, 156*d*, 156*f*, 156*h*) are disposed approximately two-thirds (⅔) of the distance from the central portions and that region of the non-selected arm portions that extends from the fold lines 152, 156 to a terminal end of each of the non-selected arm portions is adhesively secured to a select arm portion from the other sidewall forming member. This is perhaps best illustrated in FIG. 8, where central portion 120 of the first sidewall forming member 108 is secured to a first sidewall 104. The arm portion 140*b* is shown in a partially hinged conformation as the sidewalls are being deployed to the operative position. It is also evident that the sidewall portion 144*a* at the end of the first arm portion 140*b* hinges or folds along fold line 152 and begins to slide inwardly from the outermost perimeter of the second sidewall 106 toward the core. Thus, as seen in FIG. 7, the sidewall portions 144, 146 are in part disposed outwardly from the perimeter of the sidewalls. As the sidewalls are separated and the core portions collapsed from the showing in FIG. 8 to complete deployment as shown in FIG. 10, each of the sidewall portions is drawn inwardly from the position shown in FIG. 7 to that shown in FIG. 9.

Figure 9:
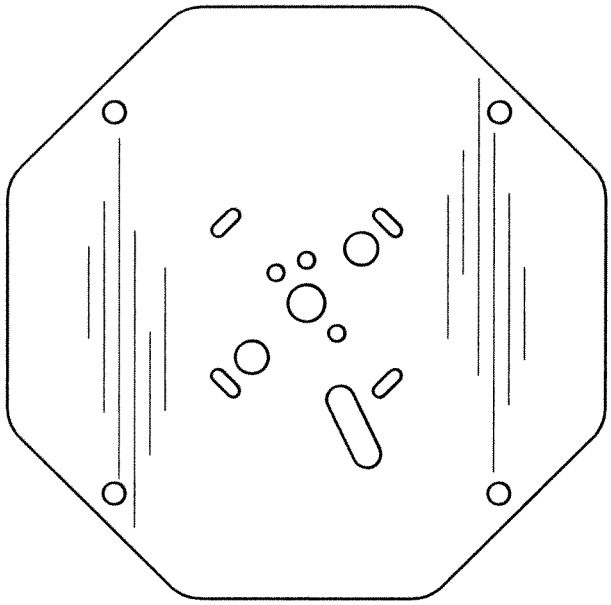
FIG. 9 is a plan view of the assembled reel.
Figure 10:
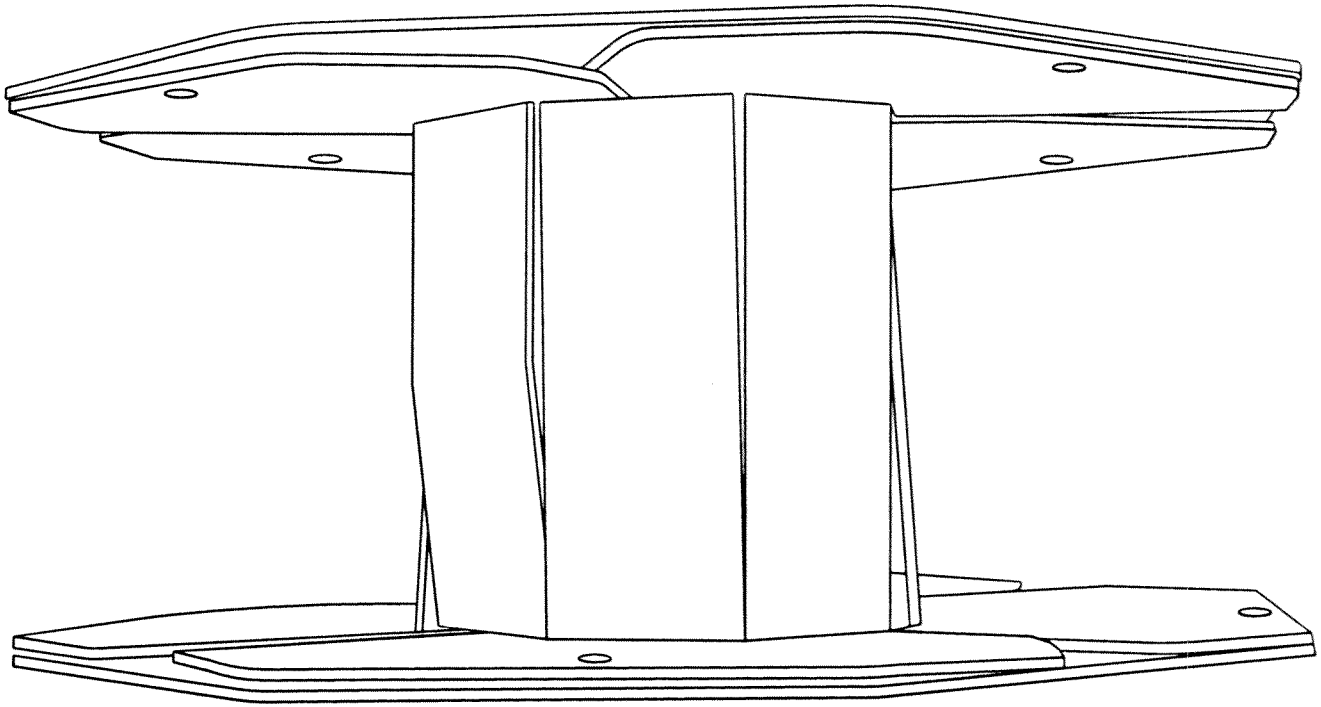
FIG. 10 is an end view of the assembled reel.

In the operative, deployed position shown in FIGS. 9 and 10, each sidewall assembly includes a sidewall and a sidewall portion that is spaced apart from the other sidewall and sidewall portion by the length of the core. Each circumferential segment of the core likewise has a double thickness along a substantial length of the core. Thus, alternating circumferential segments of the core are comprised of first arm portions 140*b*, 140*d*, 140*f*, and 140*h*, which are reinforced by second arm portions 142*b*, 142*d*, 142*f*, 142*h*. In a similar fashion, the intermediate and also alternating circumferential segments of the core are then formed by second arm portions 142*a*, 142*c*, 142*e*, 142*g* which are reinforced along a substantial portion of their inner diameter by first arm portions 140*a*, 140*c*, 140*e*, 140*g*.

As briefly noted above, the preferred embodiment includes an octagonal periphery for each of the sidewalls, and thus has eight (8) arm portions in the sidewall forming members, and four sidewall portions adapted to provide a dual thickness to each sidewall assembly. One skilled in the art will appreciate, however, that a greater or lesser number of segments can be provided, and further that the sidewalls and sidewall assemblies need not adopt a polygonal periphery if so desired.

A preferred material of construction is a corrugated paperboard, corrugated plastic, or other recyclable material. Each corrugate layer preferably includes planar surfaces interconnected by the corrugate inner layer to provide additional strength and rigidity to the structure. Again, however, single face corrugate may also be potentially used, although the single face corrugate is not as desirable. FIGS. 4 and 9 also illustrate that each of the sidewalls 104, 106 include windows or through-holes 180 dimensioned to accommodate the tab cutouts 160 (160*b*, 160*d*, 160*f*, 160*h*), 162 (162*a*, 162*c*, 162*e*, 162*g*) to extend therethrough. Thus, once the sidewalls of the reel are moved from the minimal dimension spacing or first dimension in a collapsed state (FIG. 3) through the intermediate state to the fully deployed or operative state shown in FIG. 10, the sidewalls are disposed a greater spaced-apart, second dimension from one another.

Figure 11:
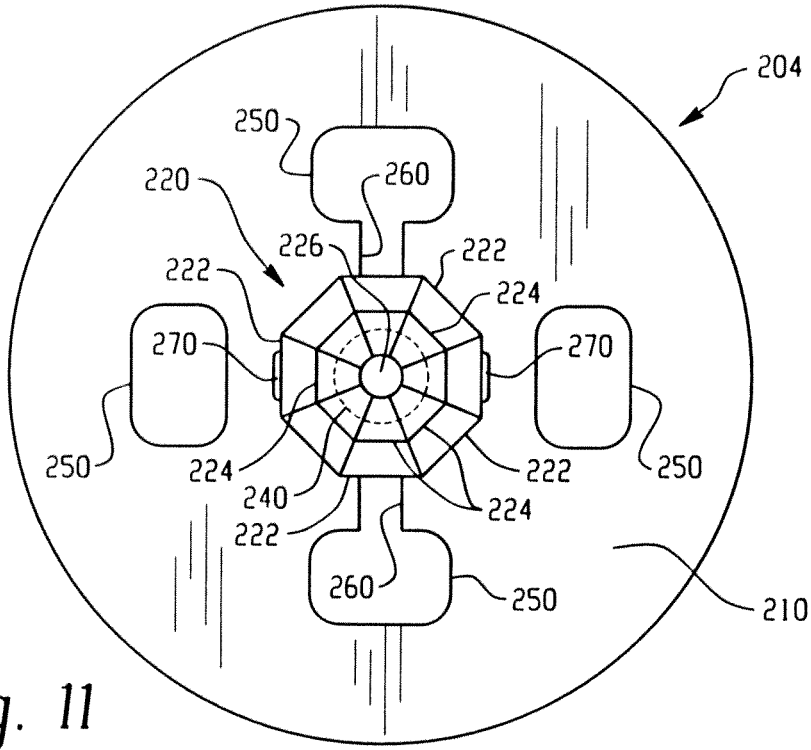
FIG. 11 plan view of the first portion of the first sidewall.
Figure 12:
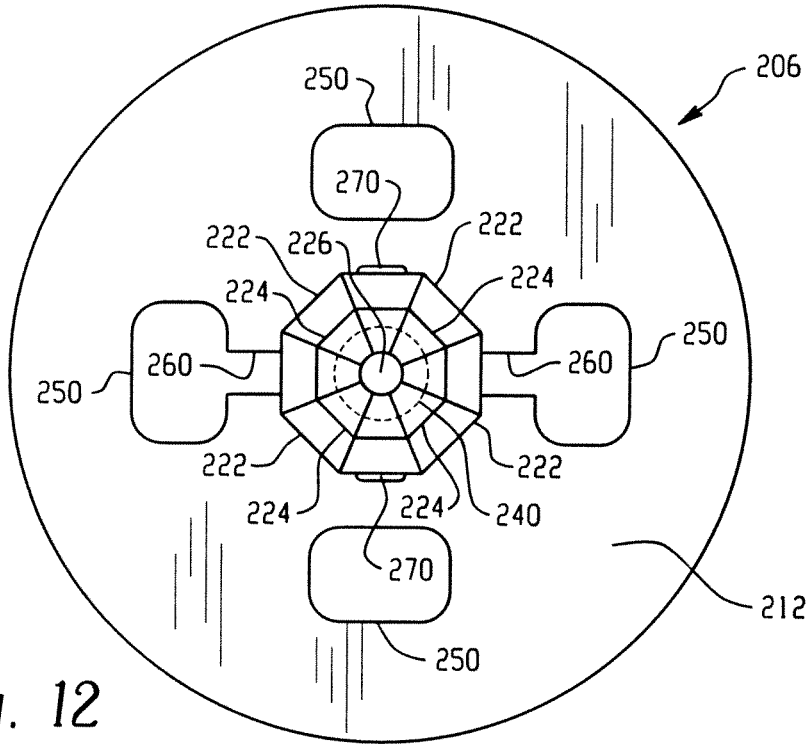
FIG. 12 is a plan view of the first portion of the second sidewall.

Turning now to FIGS. 11-15, an alternative embodiment of a collapsible reel is shown. Many similar features of the prior embodiments are incorporated in this arrangement. That is, first and second sidewalls 204, 206 are preferably identical or substantially identical to one another. Each sidewall 204, 206 includes a first portion or inner, first layer 210, 212, respectively, and a second portion or outer, second layer 214, 216, respectively. With reference to FIGS. 11 and 12, the first portions 210, 212 of the first and second sidewalls face inwardly toward one another in the assembled reel. Each of the first portions includes a series of interconnecting arms 220, which are shown as generally pie-shaped members, and cooperate with a mating interconnecting arm from the other sidewall. In the illustrated embodiment, each sidewall first portion has eight (8) interconnecting arms 220 that are each hinged along outer perimeter portions 222 to the remainder of the first portion 210, 212 and each include a second hinge portion 224 disposed radially inward from the first hinged portion 222. Inner terminal edges of the interconnecting arms form an inner opening or central opening 226 that is dimensioned to receive a spindle of the type shown in FIG. 1. That portion of each attachment arm 220 between the central opening 226 and the hinge portion 224 is adapted for adhesive engagement with an aligned, corresponding arm from the first portion of the other sidewall. Thus, an adhesive 240 is shown in dotted line in the region between the central opening 226 and the hinge region 224 so that when the first portions are disposed in facing, abutting relation, the adhesive 240 secures these arms together, and thus joins the first and second sidewalls 204, 206 through eight (8) interconnecting arms. Each of these arms flex or hinge about corresponding hinge portions 222, 224 so that the radial distance between the hinge regions generally defines the maximum spacing between the first and second sidewalls 204, 206 in a deployed condition. When disposed in a collapsed condition, the inner portions 210, 212 of each of the sidewalls 204, 206 abut one another so that the fully collapsed state of the reel allows for ease of shipping by minimizing the overall dimension of the reel.

In addition, one or more openings 250 are shown in circumferentially spaced locations in the inner, first portions of the sidewalls. These openings 250 serve multiple purposes, including allowing access to the interconnecting arms to move the sidewalls relative to one another from the collapsed position to the deployed position. In addition, when a flexible material is wrapped on the assembled reel, these openings 250 also serve to allow a user to monitor the amount of flexible material remaining on the reel. Further, preferably at least two of the openings are shown with extended cutouts 260 that extend radially inward from openings 250 toward hinge regions 222 of a pair of the interconnecting arms. The other two openings do not include these additional cutouts, but rather include small openings or recesses 270 for reasons that will become more apparent below.

Figure 13:
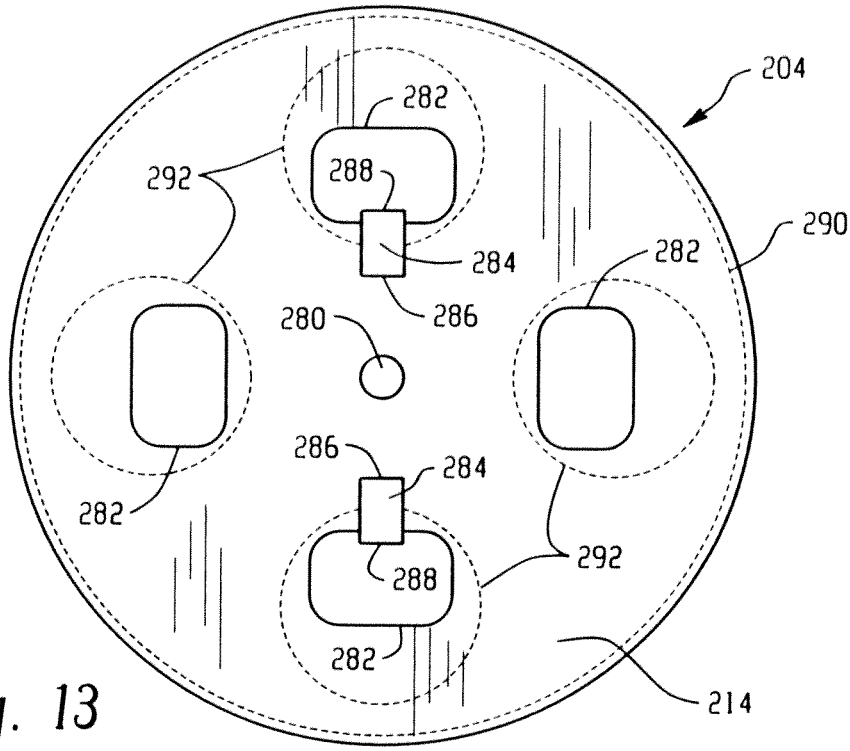
FIG. 13 is a plan view of the second portion of the first sidewall.
Figure 14:
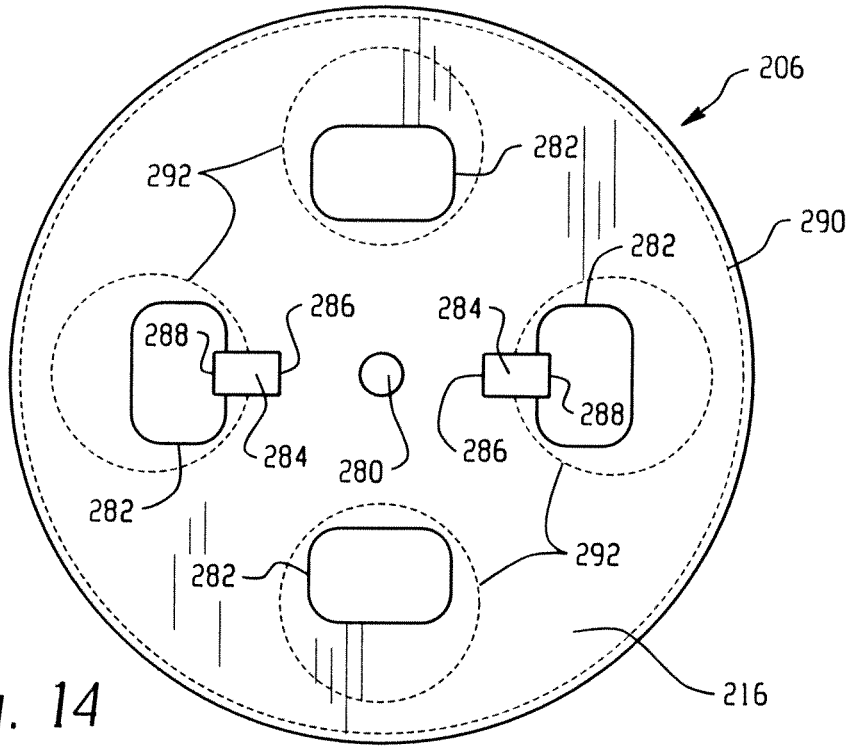
FIG. 14 is a plan view of the second portion of the second sidewall.

With continued reference to FIGS. 11 and 12, and additional reference to FIGS. 13 and 14, the outer, second portions 214, 216 of the first and second sidewalls 204, 206 will be described in greater detail. As shown, the first and second pairs of the first and second portions 210, 214 and 212, 216 have substantially identical outer perimeters, in this particular instance being circular perimeters. Each of the second portions 214, 216 include a central opening 280, as well as additional openings 282 that are dimensioned for mating alignment with openings 250 in the inner, first portions of each of the sidewalls. In addition, generally rectangular shaped reinforcing arms 284 are hingedly connected at 286 so that the reinforcing arms 284 can extend through the corresponding cutout 260 (compare FIGS. 11 and 13 and FIGS. 12 and 14). Thus, the reinforcing arms 284 are hinged at 286, extend through the corresponding openings 260 in the mating inner portion 210 or 212 of the respective sidewall, and outer terminal end 288 of each reinforcing arm is received in the narrow cutout 270 in the inner portion of the other sidewall. In other words, once the first and second sidewalls 204, 206 are moved from the collapsed to the deployed position and the interconnecting arms flex about hinge regions 222, 224, the deployed position is maintained by moving the reinforcing arms 284 through the associated cutouts 260 and inserting the terminal ends 288 of the reinforcing arms in the cutout recesses 270.

Further rigidity in the sidewalls is attained by joining the inner and outer portions together. To achieve this rigidity, it is important to securely adhere the first and second portions to one another. Thus, as illustrated in FIGS. 13 and 14, an adhesive or glue pattern is shown that achieves this objective. For example, a substantially continuous bead 290 of adhesive is provided adjacent the perimeters of and between the first and second portions of each sidewall. In addition, generally circular beads 292 of adhesive are provided around each of the aligned openings 250, 282 (without any adhesive provided on the reinforcing arms 284).

Figure 15:
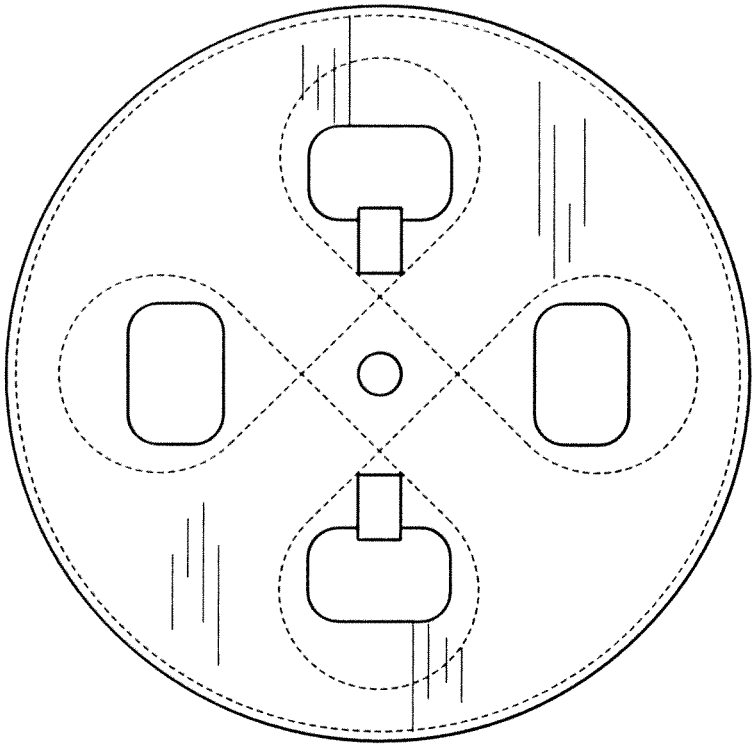
FIG. 15 is a plan view of the second portion of one of the sidewalls with an alternative adhesive pattern.

As also illustrated in FIG. 15, the series of generally continuous bead patterns around the aligned openings 250, 282 can also be a generally continuous pattern that allows continuous, robotic application of the adhesive. That is, the stream of adhesive can be continual and follow a serpentine path shown in FIG. 15. In this manner, the robotic dispensing of adhesive need only turned "on" at the beginning and then turned "off" at the end of the serpentine path, while providing a secure joining of the first and second portions of each sidewall that contributes to ease of assembly and increased rigidity of the final assembly.

The disclosure has been described with reference to the preferred embodiments. Modifications and alterations will occur to others upon reading and understanding this specification. It is intended to include all such modifications and alterations in so far as they come within the scope of the appended claims or the equivalents thereof.

Having thus described the invention, I claim:

1. A collapsible reel for storing wound items comprising:

first and second sidewalls each having a first thickness; and first and second sidewall forming members;

the first sidewall forming member including first arm portions having a length that extends from a first end to a second end and each of the first arm portions cooperating to form discrete circumferential portions of a core, selected ones of the first arm portions including sidewall portions at the second ends thereof that cooperate to engage an inner surface of at least one of the first and second sidewalls radially outward of the core and provide additional strength thereto.

2. The reel of claim 1 wherein only alternate ones of the first arm portions are the selected ones of the first arm portions.

3. The reel of claim 2 wherein the sidewall portions cover approximately one-fourth of an inner surface area of the at least one of the first and second sidewalls.

4. The reel of claim 1 wherein the sidewall portions are hinged to the second ends of the selected ones of the first arm portions.

5. The reel of claim 1 wherein the sidewall portions include locking members for mechanically engaging the respective sidewall.

6. The reel of claim 1 wherein the first arm portions include tabs extending outwardly therefrom that are selectively received in openings in the sidewalls.

7. The reel of claim 1 wherein the first and second sidewalls are spaced apart a first dimension in a collapsed state and spaced apart a greater, second dimension in an operative state.

8. The reel of claim 1 wherein the entire reel is formed from corrugate material.

9. The reel of claim 1 the core is adhesively secured at opposite ends to the first and second sidewalls, respectively.

10. The reel of claim 1 wherein the sidewall portions abut against one of the first and second sidewalls.

11. A collapsible reel for storing wound items comprising:

first and second sidewalls each having a first thickness; and first and second sidewall forming members having a central portion secured to the first and second sidewalls, respectively, the first and second sidewall forming members having first and second arm portions, respectively, each of the first and second arm portions having a length that extends from a first end to a second end and each of the first arm portions of the first sidewall forming member at least partially overlapping with one of the second arm portions of the second sidewall forming members to form discrete, double thickness portions of a core, and only some of the first and second arm portions including sidewall portions at the second ends thereof that cooperate to engage an inner surface of one of the second and first sidewalls, respectively, to provide additional strength thereto, wherein the first and second sidewalls are spaced apart a first dimension in a collapsed state and spaced apart a greater, second dimension in an operative state.

12. The reel of claim 11 further comprising locking tabs on the second ends of the first arm portions that are received in openings in the sidewalls for maintaining the core and sidewalls in the operative state.

13. The reel of claim 11 wherein the reel is formed of corrugate material.

14. The reel of claim 1 wherein less than all of the first arm portions include sidewall portions at the second ends thereof that cooperate to engage an inner surface of at least one of the first and second sidewalls.

15. The reel of claim 14 wherein the first arm portions with the sidewall portions form a double thickness with one of the first and second sidewalls.

16. The reel of claim 15 wherein the second sidewall forming member includes second arm portions cooperating to form discrete circumferential portions of the core, selected ones of the second arm portions including sidewall portions at the second ends thereof that cooperate to engage an inner surface of at least one of the first and second sidewalls radially outward of the core and provide additional strength thereto.

17. The reel of claim 16 wherein less than all of the second arm portions include sidewall portions at the second ends thereof that cooperate to engage an inner surface of at least one of the first and second sidewalls.

18. The reel of claim 16 wherein each of the first arm portions of the first sidewall forming member at least partially overlap with one of the second arm portions of the second sidewall forming members to form discrete, double thickness portions of the core.

19. The reel of claim 11 the core is adhesively secured at opposite ends to the first and second sidewalls, respectively.

20. The reel of claim 11 wherein the sidewall portions abut against one of the first and second sidewalls.

* * * * *